United States Patent [19]

Yamamoto

[11] Patent Number: 4,765,078

[45] Date of Patent: Aug. 23, 1988

[54] REEL ASSEMBLY FOR SLOT MACHINES

[75] Inventor: Toshio Yamamoto, Tokyo, Japan

[73] Assignee: Kabushiki Kaisha Universal, Tochigi, Japan

[21] Appl. No.: 625,173

[22] Filed: Jun. 25, 1984

Related U.S. Application Data

[63] Continuation of Ser. No. 447,559, Dec. 7, 1982, abandoned.

[30] Foreign Application Priority Data

Dec. 10, 1981 [IT] Italy ..... 56 184306

[51] Int. Cl.[4] ..... G09F 3/00

[52] U.S. Cl. ..... 40/309; 40/642; 40/649

[58] Field of Search ..... 40/309, 10, 16, 493

[56] References Cited

U.S. PATENT DOCUMENTS

| | | | |
|---|---|---|---|
| 1,526,007 | 2/1925 | Mills | 40/309 |
| 1,690,670 | 11/1928 | Curtis | 40/493 |
| 1,957,329 | 5/1934 | Erne | 40/309 |
| 3,973,345 | 8/1976 | Isobe | 40/309 |

*Primary Examiner*—Gene Mancene
*Assistant Examiner*—Wenceslao J. Contreras
*Attorney, Agent, or Firm*—Young & Thompson

[57] ABSTRACT

A reel assembly which comprises right and left halves of a reel interconnected by a connecting member. The width of the reel assembly is adjusted by the length of the connecting member. The right and left halves of the reel each have a rim and a holding ring with a narrow space therebetween, into which the margins of a reel tape are inserted and held.

9 Claims, 2 Drawing Sheets

REEL ASSEMBLY FOR SLOT MACHINES

This application is a continuation of application Ser. No. 447,559, filed Dec. 7, 1982 now abandoned.

BACKGROUND OF THE INVENTION

The present invention relates to a reel assembly for slot machines and, more particularly, to a reel assembly comprising right and left halves of the reel which are interconnected by a connecting member.

Slot machines of the type having a plurality of reels rotatably arranged side by side are constructed such that, when any of the predetermined prize-winning combinations of symbols occurs, the slot machine pays out coins or tokens as prizes in proportion to the number of coins or tokens which have been put in. A reel widely used in slot machines comprises many parts of metal welded or fixed by set screws.

According to a new trend in slot machines, pulse motors associated with respective reels are used to control individually the rotation of the respective reels. The smaller the size of pulse motor is, the lower it is in cost, but there is an undesirable reduction in its rotational torque. If a pulse motor with a low rotational torque is used in a slot machine, then the reel must be made lighter.

For this reason, an integrally formed reel of plastic has received practical application. Since, however, the plastic reel has been the same in construction as a conventional metal reel, it is only marginally ligher in weight. Furthermore, a metal mold of a complicated structure is necessary in order to form an integral reel, so the reel is costly.

There are slot machines of the types having three reels, four reels, or five reels. A requirement for five-reel machines is the provision of reels having a width narrower than that of the reels used with the other types of machines, so as to achieve a compact construction. Since, however, conventional reels are incompatible with different types of slot machines, it is essential to provide several kinds of reels of different width according to the types of slot machine. This is undesirable as to cost and parts control.

OBJECTS OF THE INVENTION

It is therefore a principal object of the present invention to provide a reel assembly for a slot machine, in which any desired width can be provided easily.

It is another object of the present invention to provide a reel assembly, the right and left halves of which are separately molded inexpensively in respective metal molds having a simple structure.

SUMMARY OF THE INVENTION

The above and other objects of the present invention are achieved by providing that the right and left haves of the reel are separately formed and are interconnected by means of a connecting member to complete an integral reel. Upon interconnecting the right and left havles of the reel, a desired width of reel can be provided by leaving the proper space between the right and left flanges of the reel.

In a preferred embodiment of the present invention, the right and left havles of reel have respectively a ring member, and a rim and a holding ring which project laterally from and perpendicular to the ring and between which a reel tape with an annular series of spaced symbols provided thereon is firmly held. In the assembled reel, a space is left between the rims of the respective halves of reel, whereby the reel is made lighter in weight.

Other objects and features of the present invention will become apparent from the following detailed description of preferred embodiments of the invention taken in conjunction with the accompanying drawings.

DETAILED DESCRIPTION OF THE INVENTION

Figure 1:
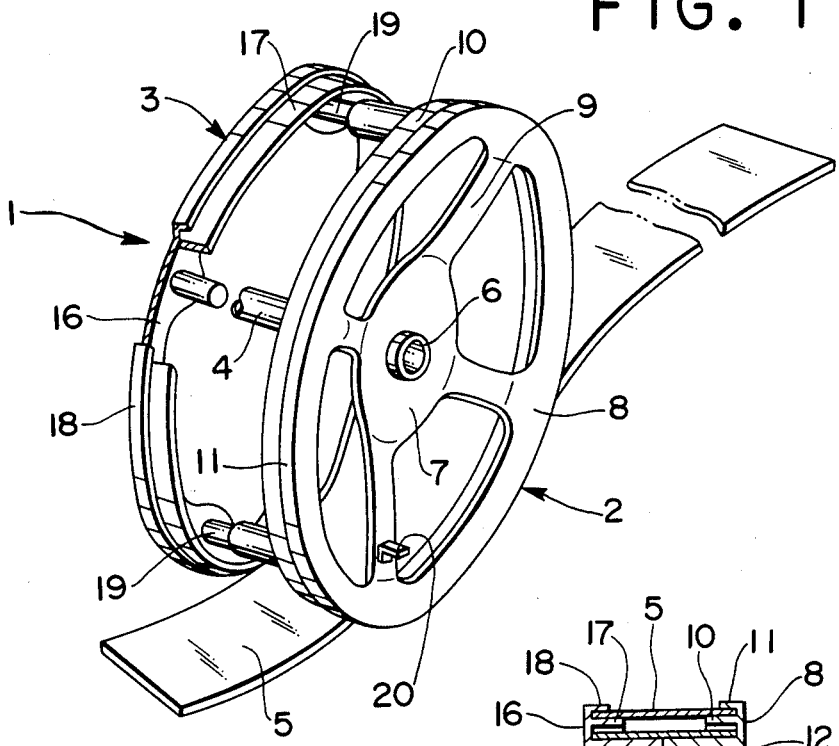
FIG. 1 is a perspective view of a reel assembly embodying one form of the present invention, with parts broken away.
Figure 2:
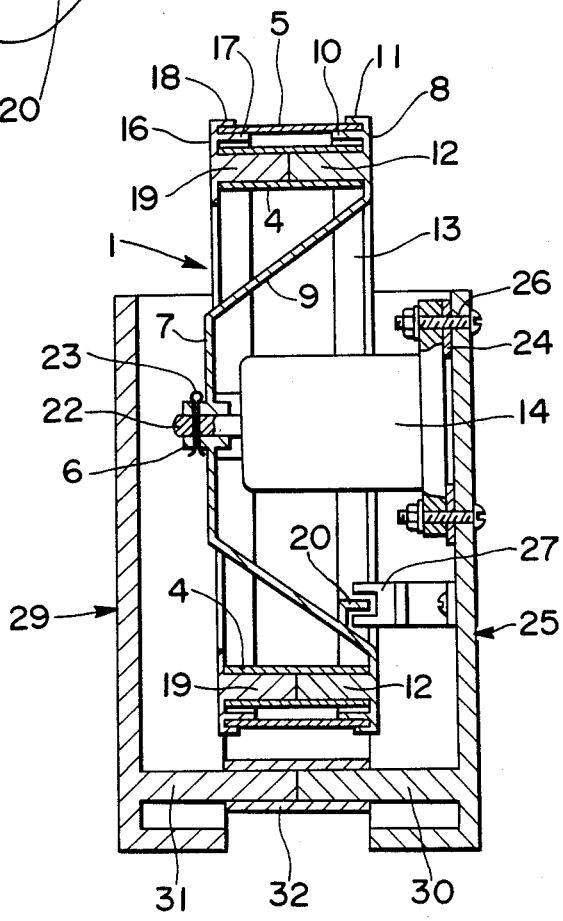
FIG. 2 is a cross-sectional view of the reel assembly incorporated in a slot machine which is partly shown.

The present invention will be explained with reference to the attached drawings showing various embodiments thereof. In FIGS. 1 and 2, a reel assembly 1 comprises a right half of reel 2, a left half of reel 3, liner sleeves 4 for interconnecting the right and left havles of reel 2 and 3, and a reel tape 5 on the outer surface of which is printed or otherwise provided an annular series of spaced symbols such as a cherry, a lemon, a figure or the like and which has preferably a certain rigidity.

The right half of reel 2 includes a boss 6, an inner ring 7 surrounding the boss 6, an outer ring 8 located in a different plane from the plane of inner ring 7, a plurality of arms 9 extending between the inner and outer rings 7 and 8 so as to interconnect them, an annular flange 10 projecting laterally from and perpendicular to the outer ring 8, and an annular holding ring 11 projecting laterally from and perpendicular to the outer ring 8 so as to encircle the annular rim 10 with a narrow space therebetween. In said narrow space, the reel tape 5 along its one margin is inserted and firmly held; and a plurality of connecting bosses 12 project laterally from and perpendicular to the outer ring 8. These components are integrally molded of the same plastic as the right half 2 of the plastic reel.

The inner and outer rings 7 and 8 lying on spaced parallel planes from a frustoconical depression 13 in which is received a part of a pulsing motor 14, as shown in FIG. 2.

The left half of reel 3 has the same construction as the right half of reel 2 except there is no boss, no inner ring nor plurality of arms. Half 3 is also integrally formed of plastic.

The right and left havles of reel 2 and 3 are united by a plurality of liner sleeves 4 into which the connecting bosses 12 and 19 are pressed from both sides to complete an entire reel assembly 1. The width of the reel assembly 1 depends on the length of the liner sleeve 4.

The tape 5 is assembled in the reel assembly in such a way that both margins of the tape 5 are inserted in the narrow spaces and then adhered to the rims 10 and 17. Designated by the numeral 20 is a member which is secured to the reel and passes through a photo-interrupter 27 for detecting the position of the reel.

Referring to FIG. 2, the reel assembly 1 with the right and left halves of the reel united by the liner sleeves 4 is mounted on and fixed by, for instance, set screws to a rotating output shaft 22 of a pulsing motor 14 which is attached to a right side wall 25 of a reel housing by bolts 26 through a rubber vibration damper 24. The rubber vibration damper 24 serves to prevent the reel assembly 1 from joggling in the rotation direction when the pulsing motor 14 stops. Attached to the right side wall 25 of the reel housing is a photo-interrupter 27 which can detect the passage of the member 20 therethrough.

The reel housing comprises the right side wall 25 and a left side wall 29 opposed thereto and interconnected by connecting rods 30 and 31 provided on the walls 25 and 29, respectively, received in a liner sleeve 32. The combination of the reel assembly 1 and the reel housing as a unit is installed into the slot machine housing along with other reel units.

Completing reel assembly 1 by interconnecting the right and left halves of the reel with the liner sleeves 4 makes it possible to adjust the reel assembly to the desired width so as to allow the reel assembly to be available commercially in slot machines of various sizes. There are many ways of performing this adjustment, several examples of which are shown in FIGS. 3A–3D.

Figure 3A:
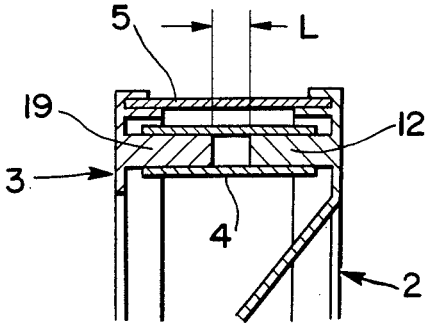
FIGS. 3A–3D are segmentary sectional views showing several ways of providing a desired width of the reel assembly.

In FIG. 3A the connecting bosses 12 and 19 are interconnected, separated by distance L, by the connecting sleeve 4 so as to widen the reel assembly by the distance L more than the reel assembly 1 shown in FIG. 2. Otherwise, the use of a desired length of connecting sleeve 4 will facilitate the completion of the reel assembly.

Figure 3B:
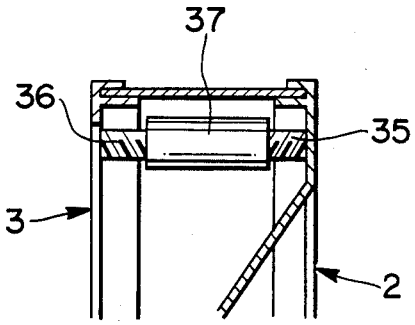

FIG. 3B illustrates a reel assembly with its right and left halves interconnected by means of a turnbuckle which comprises two screw rods 35 and 36 threaded in the opposite direction and a pipe nut 37. In this reel assembly, the width of the reel assembly can be adjusted by rotating the pipe nut 37.

Figure 3C:
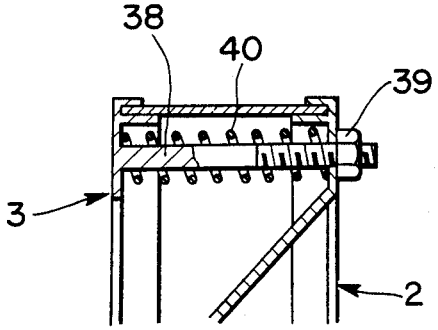

In FIG. 3C, the left half of reel 3 is provided with an elongated bolt 38 the tip portion of which extends through a hole in the right half of reel 2 and is tightened with a nut 39. Between the right and left halves of reel 2 and 3 a coil spring 40 surrounding the elongated bolt 38 is provided so as to increase the distance. So, by moving the right half of the reel by turning the nut 39, the width of the reel assembly can be easily varied.

Figure 3D:
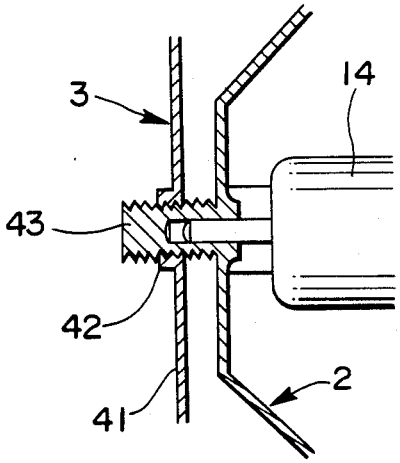

FIG. 3D illustrates a reel assembly wherein the left half of reel 3 is further provided with a plurality of arms 41 and a boss 42 having female threads. The right half of reel 2 is provided with a screw boss 43. By rotation of the threaded engagement between the boss 42 and 43, the width of the reel assembly can be properly adjusted.

While specific embodiments of the invention have been shown and described in detail to illustrate the application of the inventive principles, it will be understood that the invention may be embodied otherwise without departing from the scope of the appended claims.

What is claimed is:

1. A reel assembly for a slot machine comprising a right half of the reel; a left half of the reel, and connecting means for interconnecting said right and left halves of the reel, said right and left halves of the reel having a plurality of connecting bosses spaced apart about the periphery of each reel half and projecting toward each other, and means interconnecting said bosses so as to interconnect said right and left halves of the reel.

2. A reel assembly as defined in claim 1, said connecting means comprising a plurality of liner sleeves into which said connecting bosses are inserted from opposite ends thereof so as to interconnect said right and left halves of the reel.

3. A reel assembly as defined in claim 2, wherein a desired width of the reel assembly is provided according to the amount by which said connecting bosses are inserted into said connecting liner sleeves.

4. A reel assembly as defined in claim 1, said right half of the reel comprising a central boss fixable to the output shaft of a driving means, an inner ring surrounding and radially extending from said central boss, an outer ring having an diameter larger than that of said inner ring, a plurality of arms extending between said inner and outer rings, and on the outer ring a rim and holding ring with a narrow space therebetween, said rim and holding ring projecting laterally from and perpendicularly to said outer ring, said left half of the reel comprising an outer ring similar to said right half of the reel in shape, and on the outer ring a rim and holding ring with a narrow space therebetween, said rim and holding ring projecting laterally from and perpendicularly to said outer ring on said left half, in the direction of said rim and holding ring on said right half, said assembly further comprising a tape, on the outer surface of which an annular series of symbols is provided and the side margins of which are inserted into and firmly held in said narrow spaces, said bosses projecting toward each other laterally from and perpendicularly to said outer rings.

5. A reel assembly for a slot machine comprising a right half of the reel; a left half of the reel; and connecting means for interconnecting said right and left halves of the reel, each said half comprising a ring having two spaced flanges extending from one ring toward the other ring but terminating in fee edges a substantial distance short of the other ring, and a tape on the outer surface of which an annular series of symbols is provided and the side margins of which are inserted into and firmly held between said flanges.

6. A reel assembly as defined in claim 5, said interconnecting means comprising a plurality of turnbuckles, each of which comprises screw rods threaded in the opposite direction on said right and left halves of the reel, and a pipe nut in threaded engagement with each screw rod.

7. A reel assembly as defined in claim 5, wherein said interconnecting means comprises a screw bolt on one of said halves of the reel, a hole in the other half of the reel through which said screw bolt extends, a coil compression spring surrounding said screw bolt so as to spread apart said right and left halves of the reel in opposite directions, and a nut threaded on said screw bolt for tightenting said other half of the reel against the action of said coil spring.

8. A reel assembly as defined in claim 5, wherein said interconnecting means comprises threads provided internally on said central boss, and a boss with external threads which is connected to said outer ring of said left half of the reel by a plurality of arms.

9. A reel assembly for a slot machine comprising a right half of the reel; a left half of the reel; and connecting means for interconnecting said right and left halves of the reel, the right half of the reel comprising a central boss fixable to the output shaft of a driving means, an inner ring surrounding and radially extending from said central boss, an outer ring having a diameter larger than that of said inner ring, a plurality of arms extending from said inner ring diagonally outwardly to said outer ring, said arms underlying said left half of the reel thereby to permit a said driving means to be partially nested in the reel assembly.

* * * * *